US007419393B2

(12) United States Patent
Milan

(10) Patent No.: US 7,419,393 B2
(45) Date of Patent: Sep. 2, 2008

(54) UNIVERSAL COMPUTER CABLE KIT WITH INTERCHANGEABLE QUICK CONNECTORS

(76) Inventor: Henry Milan, 1709 Apple Ridge Ct., Rochester Hills, MI (US) 48306

( * ) Notice: Subject to any disclaimer, the term of this patent is extended or adjusted under 35 U.S.C. 154(b) by 312 days.

(21) Appl. No.: 10/965,641

(22) Filed: Oct. 14, 2004

(65) Prior Publication Data

US 2005/0070154 A1 Mar. 31, 2005

Related U.S. Application Data

(63) Continuation-in-part of application No. 10/328,519, filed on Dec. 23, 2002, now Pat. No. 7,004,787.

(60) Provisional application No. 60/401,900, filed on Aug. 8, 2002, provisional application No. 60/387,796, filed on Jun. 11, 2002.

(51) Int. Cl.
*H01R 29/00* (2006.01)

(52) U.S. Cl. ..... 439/171

(58) Field of Classification Search ..... 439/502, 439/35, 503, 433, 434, 218, 640, 851, 850, 439/842, 845, 849, 217, 222, 638, 171, 120, 439/578–585, 675, 170, 172, 166
See application file for complete search history.

(56) References Cited

U.S. PATENT DOCUMENTS

| | | | | |
|---|---|---|---|---|
| 2,776,415 | A | 1/1957 | McGinley | |
| 3,885,849 | A * | 5/1975 | Bailey et al. | 439/518 |
| 4,057,310 | A * | 11/1977 | Young | 439/35 |
| 4,310,213 | A | 1/1982 | Fetterolf, Sr. et al. | |
| D295,971 | S | 5/1988 | Kikuta | |
| D301,870 | S | 6/1989 | Shibano | |
| 4,846,697 | A * | 7/1989 | Rodgers | 439/35 |
| 5,119,020 | A * | 6/1992 | Massey et al. | 324/754 |
| 5,197,900 | A | 3/1993 | Ellis et al. | |
| 5,236,373 | A | 8/1993 | Kennedy | |
| 5,315,062 | A | 5/1994 | Hoshino | |
| 5,370,550 | A | 12/1994 | Alwine et al. | |
| 5,425,653 | A | 6/1995 | Koiso | |
| 5,445,534 | A | 8/1995 | Ishizuka et al. | |
| 5,609,501 | A * | 3/1997 | McMills et al. | 439/578 |
| 5,637,009 | A | 6/1997 | Tsuji et al. | |
| 5,658,170 | A | 8/1997 | Tan et al. | |
| 5,692,918 | A | 12/1997 | Hill | |
| 5,772,453 | A | 6/1998 | Tan et al. | |
| 5,772,472 | A | 6/1998 | Beutler et al. | |
| 5,823,814 | A | 10/1998 | Alwine | |
| D405,053 | S | 2/1999 | Tan et al. | |
| 5,954,523 | A | 9/1999 | Babcock | |
| 5,961,351 | A | 10/1999 | Wu | |
| 5,975,954 | A | 11/1999 | Wu et al. | |

(Continued)

FOREIGN PATENT DOCUMENTS

| | | |
|---|---|---|
| DE | 100 31 954 | 3/2001 |

(Continued)

*Primary Examiner*—Edwin A. León
(74) *Attorney, Agent, or Firm*—Butzel Long

(57) ABSTRACT

A universal computer cable kit includes a universal cable having quick connector portions on opposing ends thereof, a plurality of interchangeable connectors for attachment to the quick connector portions, a container for storing the interchangeable connectors, and a blister pack for packaging and displaying the kit.

19 Claims, 10 Drawing Sheets

U.S. PATENT DOCUMENTS

| | | | | |
|---|---|---|---|---|
| 6,007,380 | A | 12/1999 | Shimojyo | |
| 6,007,382 | A | 12/1999 | Wu | |
| 6,010,348 | A | 1/2000 | Alden | |
| 6,080,012 | A | 6/2000 | Zhu et al. | |
| 6,089,879 | A | 7/2000 | Babcock | |
| 6,155,872 | A | 12/2000 | Wu | |
| 6,171,136 | B1 | 1/2001 | Liu et al. | |
| 6,183,292 | B1 | 2/2001 | Chen et al. | |
| 6,210,231 | B1 | 4/2001 | Lai | |
| 6,215,656 | B1 | 4/2001 | O'Neal et al. | |
| 6,217,378 | B1 | 4/2001 | Wu | |
| 6,220,872 | B1 | 4/2001 | Chen | |
| D443,251 | S | 6/2001 | Wang et al. | |
| 6,250,955 | B1 | 6/2001 | Archuleta | |
| 6,257,930 | B1 | 7/2001 | Turner et al. | |
| 6,309,255 | B1 | 10/2001 | Yu | |
| 6,334,793 | B1 | 1/2002 | Amoni et al. | |
| 6,346,002 | B1 | 2/2002 | Hsu et al. | |
| 6,358,088 | B1 | 3/2002 | Nishio et al. | |
| 6,406,313 | B1 * | 6/2002 | Victor | 439/175 |
| 6,466,437 | B1 | 10/2002 | Sakuragi et al. | |
| 6,637,909 | B1 * | 10/2003 | Bryan | 362/156 |
| 6,908,324 | B1 * | 6/2005 | Morley et al. | 439/218 |

FOREIGN PATENT DOCUMENTS

| | | |
|---|---|---|
| EP | 1 100 158 | 5/2001 |
| JP | P2001-209460 | 3/2001 |

* cited by examiner

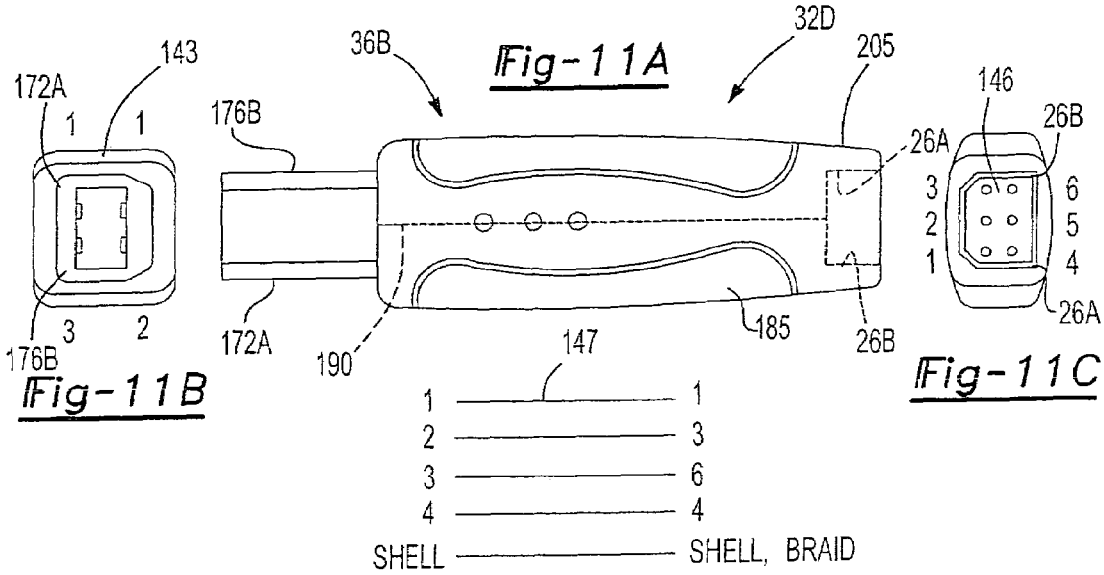
Fig-11A
Fig-11B
Fig-11C
Fig-11D
32D
36B
205
143
172A
176B
146
26B
26A
147
190
185
1
2
3
4
SHELL
SHELL, BRAID
6
5
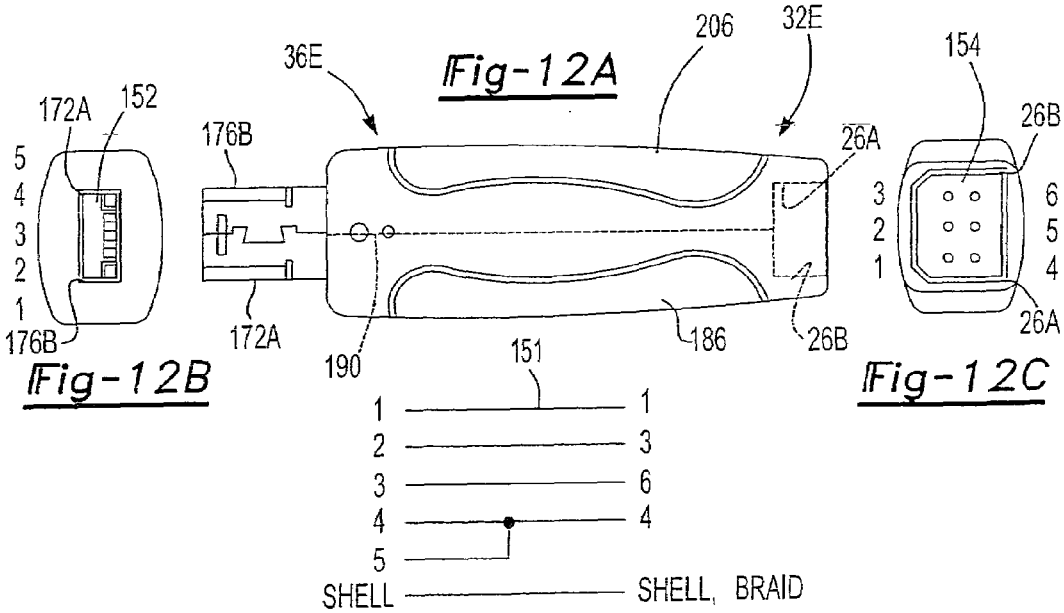
Fig-12A
Fig-12B
Fig-12C
Fig-12D
206
32E
36E
154
152
172A
176B
26B
26A
190
186
151
1
2
3
4
5
6
SHELL
SHELL, BRAID

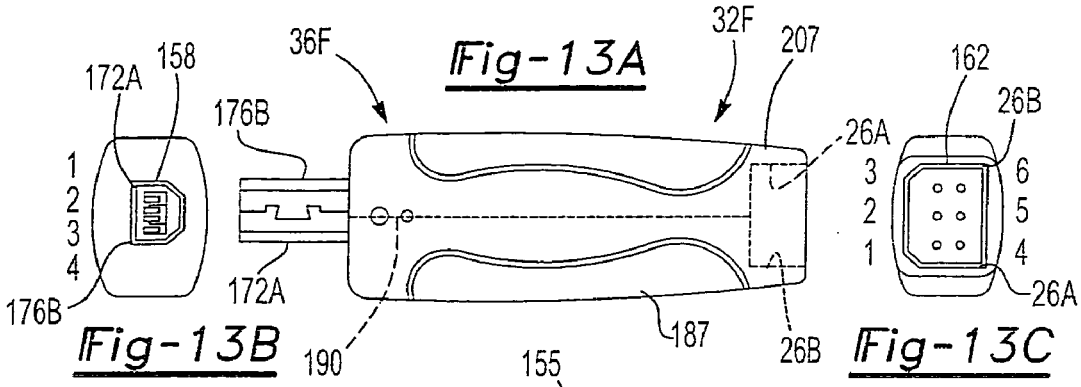
Fig-13A
Fig-13B
Fig-13C
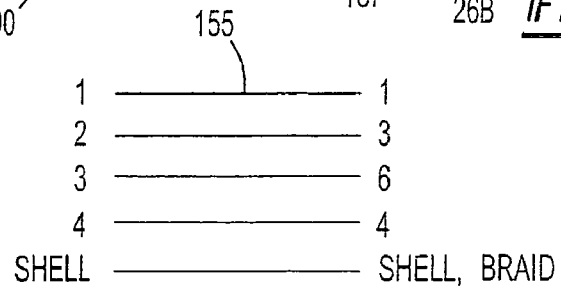
Fig-13D

UNIVERSAL COMPUTER CABLE KIT WITH INTERCHANGEABLE QUICK CONNECTORS

CROSS-REFERENCE TO RELATED APPLICATIONS

This application is a continuation-in-part of U.S. patent application Ser. No. 10/328,519 filed Dec. 23, 2002, now U.S. Pat. No. 7,004,787, issued Feb. 28, 2006, which claims the benefit of U.S. Provisional Patent Application Ser. No. 60/387,796, filed Jun. 11, 2002, and U.S. Provisional Patent Application Ser. No. 60/401,900, filed Aug. 8, 2002.

FIELD OF THE INVENTION

The present invention relates to computers, computer peripherals, computer related devices, and other devices which may benefit from a quick and efficient method and/or system for connection to other like or different devices. More particularly, the present invention relates to a system and method for connecting computers and/or computer peripherals to other computers and/or computer peripherals. Most particularly, the present invention relates to a universal computer cable having universal connector portions and interchangeable quick connectors, and a universal cabling system and method of using the quick connectors to connect computers, computer peripherals, computer related devices and other devices together.

DESCRIPTION OF RELATED ART

The fields of computers, computer peripherals, and computer related devices are rapidly expanding. All of these devices must be connected to one another to communicate. This has caused a problem in the art due to the large number of connector types and cable lengths, which are currently used. Many of these devices currently use universal serial bus (USB) or Firewire® computer architecture.

The USB architecture uses a four wire cable, or whatever the current USB specification calls for, usually in six, ten, or fifteen foot lengths, having seven different configurations possible on one end of the cable, and three different configurations possible on the other end of the cable, making possible many different configurations in each of the three popular lengths. Current USB Standards do not permit a cable length greater than fifteen feet without a repeater.

Five different types of plugs (male) or receptacles (female) are used on the ends of the USB cables to form these configurations. These are a USB A Male, USB B Male, MiniUSB A Male and MiniUSB B Male plugs, as well as a USB A Female receptacle. Any one of these plugs or receptacles may be found on either end of a USB cable. The only limitation on the possible combinations is that an A Male USB plug is not used with a MiniUSB A Male plug, and a MiniUSB B Male plug is not used with a USB B Male plug.

Firewire® computer architecture uses a four or six wire cable, or whatever the current Firewire® specification calls for, usually in the same lengths as a USB cable, and having a six pin Firewire® computer connector on one or both ends of a Firewire® cable, and a four pin audio-visual connector, which also may be on one, or both, ends of a Firewire® cable, thus providing additional cable configurations.

The large number of cable configurations causes problems in the art for the computer and/or peripheral, or device manufacturer, the wholesaler, the retailer, and the user, all of whom are put to the expense of manufacturing and/or stocking and/or selling and/or buying and/or using a bewildering array of cables to connect computers and/or computer peripherals to other computers and/or computer peripherals or devices. Thus, those skilled in the art have begun to search for an easier and less costly way to accomplish these connections.

SUMMARY OF THE INVENTION

The present invention solves the aforementioned problems in the art by providing a universal computer cable useable for standard USB or Firewire® computer architecture, and having novel quick connectors which provide for the use of interchangeable quick connectors with the cable, and a cabling system and method of using the cable and the quick connectors to connect between standard connectors on computers, computer peripherals, computer related devices, and other devices.

The present invention also concerns a universal computer cable kit that includes a universal cable portion having connector portions on opposing ends thereof, a plurality of interchangeable mating quick connectors (plugs, receptacles or converters), a container for storing the interchangeable quick connectors, and a blister pack for packaging and displaying the kit.

The universal computer cable kit includes a universal cable portion having a first end and a second end electrically connected to said first end, and a pair of universal cable connector portions, each of the connector portions being electrically and mechanically connected to an associated one of the cable portion ends to form a universal cable. The kit also includes at least four interchangeable quick connectors each adapted to be releasably attached to the connector portions of the first and second ends and being adapted to electrically connect standard connectors of a pair of electrical devices. The kit further includes a container for storing the quick connectors when not in use on the universal cable and a blister pack enclosing the universal cable, the quick connectors and the container. The blister pack has a transparent wall having a plurality of protuberances formed therein receiving the universal cable, the quick connectors and the container at a point of sale.

At least one of the quick connectors includes one of a 4-Pin USB Series "A" Receptacle, a 4 Pin USB Series "A" Plug, a 4-Pin USB Series "B" Plug, a 5-Pin USB 2.0 Specification Mini-"A" Plug, a 4-Pin USB 2.0 Specification Mini-"B" Plug, a Firewire®-IEEE Standard 1394a-2000 4-Circuit plug and a Firewire®-IEEE Standard 1394-1995 6-Circuit Plug.

In one version, the universal computer cable kit the cable connector portions and the universal cable portion a universal cable for connecting USB devices wherein the interchangeable quick connectors electrically connect standard USB connectors of a pair of the USB devices through the cable portion. Thus the quick connectors include one of a 4-Pin USB Series "A" Receptacle, a 4 Pin USB Series "A" Plug, a 4-Pin USB Series "B" Plug, a 5-Pin USB 2.0 Specification Mini-"A" Plug, and a 4-Pin USB 2.0 Specification Mini-"B" Plug.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 7A is a top plan view of a plug, receptacle or converter embodying the quick connector construction shown in FIG. 5A;

FIG. 7B is a left side view of the connector of FIG. 7A;

FIG. 7C is a right side view of the connector of FIG. 7A;

FIG. 8A is a top plan view of a first modification of the quick connector shown in FIG. 7A;

FIG. 8B is a left side view of the connector of FIG. 8A;

FIG. 8C is a right side view of the connector of FIG. 8A;

FIG. 9A is a top plan view of a second modification of the quick connector shown in FIG. 7A;

FIG. 9B is a left side view of the connector of FIG. 9A;

FIG. 9C is a right side view of the connector of FIG. 9A;

FIG. 10A is a top plan view of a third modification of the quick connector shown in FIG. 7A;

FIG. 10B is a left side view of the connector of FIG. 10A;

FIG. 10C is a right side view of the connector of FIG. 10A;

FIG. 11A is a top plan view of a forth modification of the quick connector shown in FIG. 7A;

FIG. 11B is a left side view of the connector of FIG. 11A;

FIG. 11C is a right side view of the connector of FIG. 11A;

FIG. 11D is a pin-out diagram of the connector of FIG. 11A;

FIG. 12A is a top plan view of a fifth modification of the quick connector shown in FIG. 7A;

FIG. 12B is a left side view of the connector of FIG. 12A;

FIG. 12C is a right side view of the connector of FIG. 12A;

FIG. 12D is a pin-out diagram of the connector of FIG. 12A;

FIG. 13A is a top plan view of a sixth modification of the quick connector shown in FIG. 7A;

FIG. 13B is a left side view of the connector of FIG. 13A;

FIG. 13C is a right side view of the connector of FIG. 13A;

FIG. 13D is a pin-out diagram of the connector of FIG. 13A;

It is to be understood that the present invention is not limited to the details of construction and arrangement of parts illustrated in the accompanying drawings, since the present invention is capable of other embodiments and of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

Figure 1:
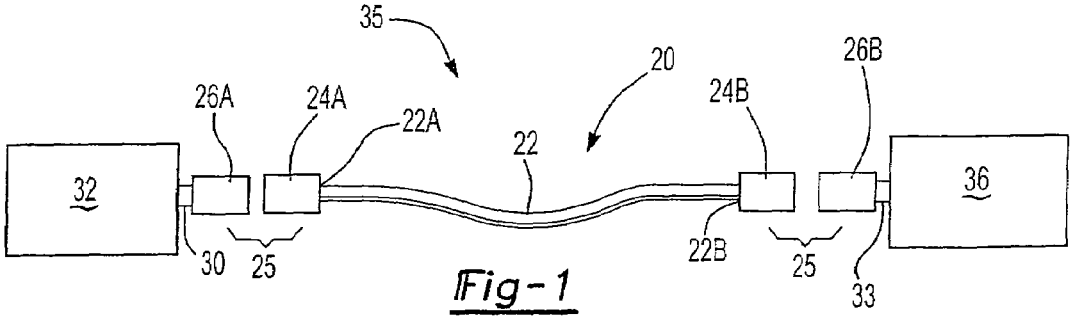
FIG. 1 is a diagrammatic view of a universal cable embodying the present invention.

Referring to FIG. 1, there is illustrated a diagrammatic view of a universal cable system, generally indicated by the numeral 35, which generally includes a universal cable 20 having a universal cable portion 22. The universal cable portion 22 comprises a predetermined length of a USB cable, Firewire® cable, or other suitable cable for the purpose intended. The universal cable portion 22 has a universal cable portion first end and a universal cable portion second end, 22A and 22B, respectively.

The universal cable portion first end 22A is mechanically and electrically attached to a universal cable first connector portion 24A and the universal cable portion second end 22B is mechanically and electrically attached to a universal cable second connector portion 24B, said portions 24A and 24B preferably are, but not necessarily, female. Hence the universal cable first connector portion 24A is in electrical communication with the universal cable second connector portion 24B. Thus the combination of the universal cable portion 22, and the universal connector portions 24A and 24B defines the basic universal cable 20. In the first preferred embodiment of the present invention, the universal cable first connector portion 24A is identical to the universal cable second connector portion 24B.

Also shown in FIG. 1 are two universal cable connectors 25, which comprise a combination of the universal cable first connector portion 24A and a quick connect first mating connector portion 26A, or a combination of the universal cable second connector portion 24B and a quick connect second mating connector portion 26B. Thus the universal cable 20 may be further defined as the combination of the universal cable portion 22 and the two universal cable connectors 25. If the universal cable 20 is mateably attached to first and second USB or Firewire® plugs, receptacles, or converters (32 and 36 respectively), then the universal cable 20 of the present invention may be referred to as a universal USB cable or a universal Firewire® cable, respectively, of the universal cable system 35.

Figure 2:
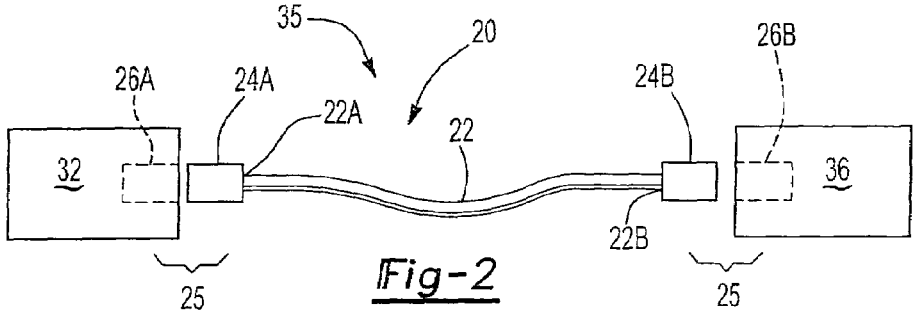
FIG. 2 is a diagrammatic view of a modification of the cable shown in FIG. 1.

Referring to FIG. 2, there is shown a modification of the present invention, which is in large part similar to that shown in FIG. 1, with an additional feature that the quick connect first mating (or male) connector portion 26A is formed integrally with the first serial bus plug, Firewire® plug, receptacle or converter 32. Similarly, the quick connect second mating (or male) connector portion 26B is formed integrally with the second USB plug, receptacle, Firewire® plug, or converter 36. Thus a quick connect first cable portion 30 and a quick connect second cable portion 33 are eliminated, making the modification of the invention shown in FIG. 2 simpler and less costly to produce than the version shown in FIG. 1.

Figure 3:
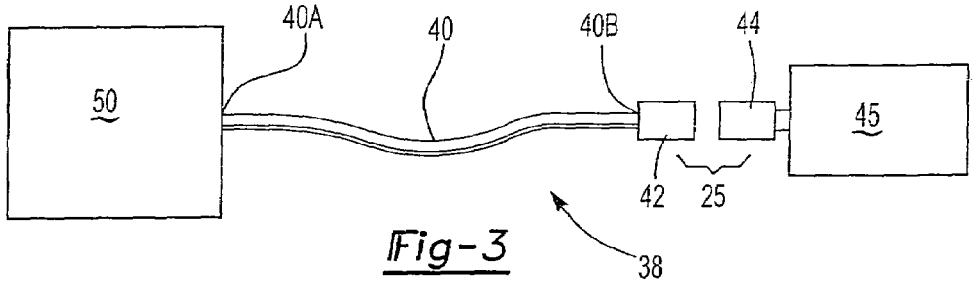
FIG. 3 is a diagrammatic view of a further modification of the cable shown in FIG. 1.

Referring to FIG. 3, a universal serial bus cabling system 38 may be provided, in accordance with the present invention, by providing a universal serial bus cable portion 40, or one of the other types of cables mentioned above. The universal serial bus cable has a universal serial bus cable first end 40A and a universal serial bus cable second end 40B with at least a universal first system connector 42 electrically connected to the universal serial bus cable second end 40B. Further provided is at least one quick connect system serial bus plug or receptacle or converter 45, which may be miniature in size, and having a quick connect system mating connector 44 that is capable of making mateable electrical and mechanical attachment to the universal first system connector 42. With the universal serial bus cable first end 40A of the universal serial bus cable 40 being electrically and mechanically connected to a computer, computer peripheral, computer related device, or other device 50, the present invention is thus capable of providing the universal serial bus cabling system 38 that possesses interchangeability of plugs, receptacles, Firewire® plugs, or converters for electrical communications between computer peripherals and/or computers or other electronic devices.

Figure 4:
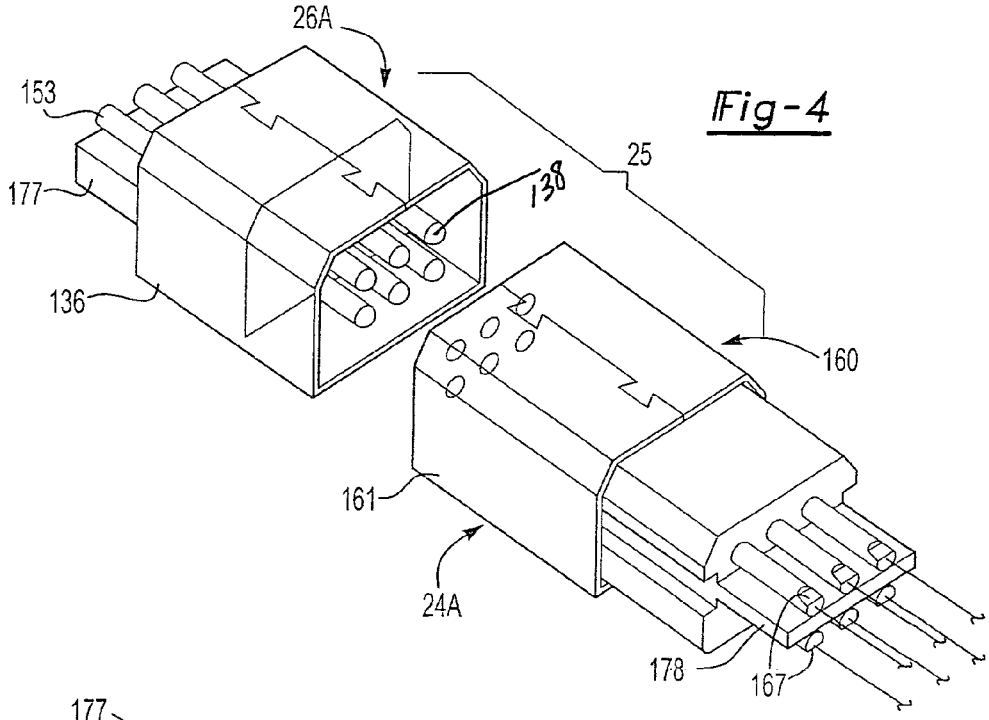
FIG. 4 is an exploded, perspective, view of the universal cable connector shown in FIGS. 1-3.

Referring to FIG. 4, there is illustrated the universal cable connector 25 comprising the universal cable first (typically, female) connector portion 24A, and the universal cable quick connect first mating (typically, male) connector portion 26A. In the present invention a combination of the universal cable second (typically, female) connector portion 24B and the universal cable quick connect second mating (typically, male) connector portion 26B, and a combination of the universal first system connector 42 and the quick connect system mating connector 44 also form a universal cable connector 25.

Figure 6A:
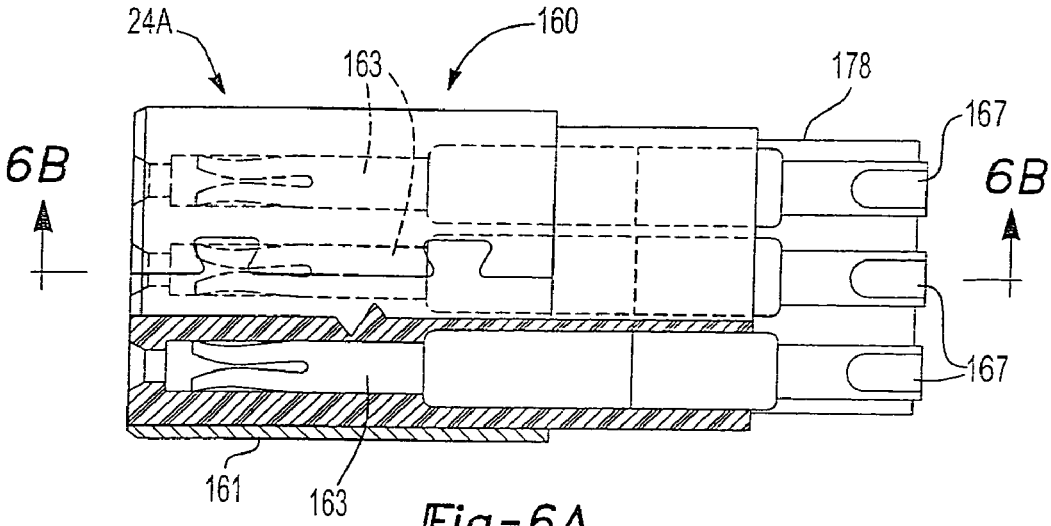
FIG. 6A is a top plan view, partially in section, of the female portion of the connector illustrated in FIG. 4.
Figure 6B:
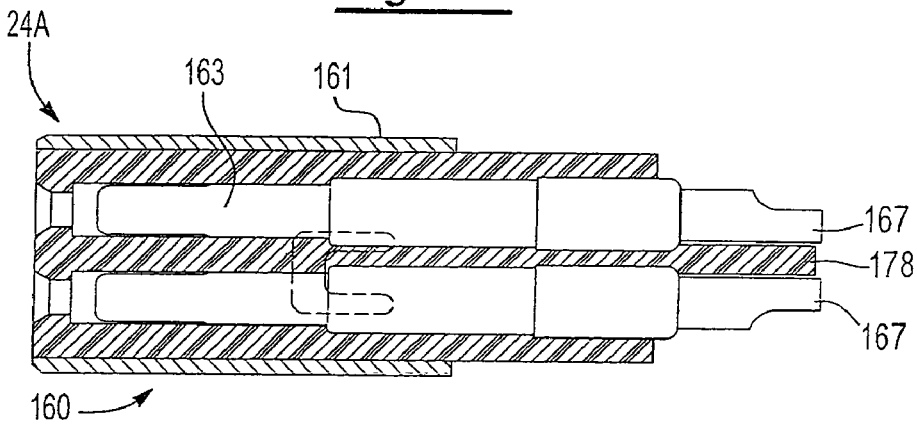
FIG. 6B is a sectional view, taken in the direction of the arrows, along the section line 6B-6B of FIG. 6A.
Figure 6C:
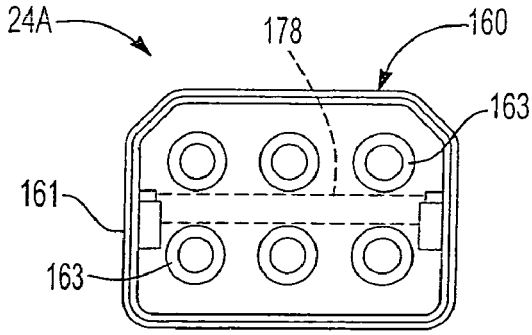
FIG. 6C is a left end view of the connector shown in FIG. 6B.
Figure 7D:
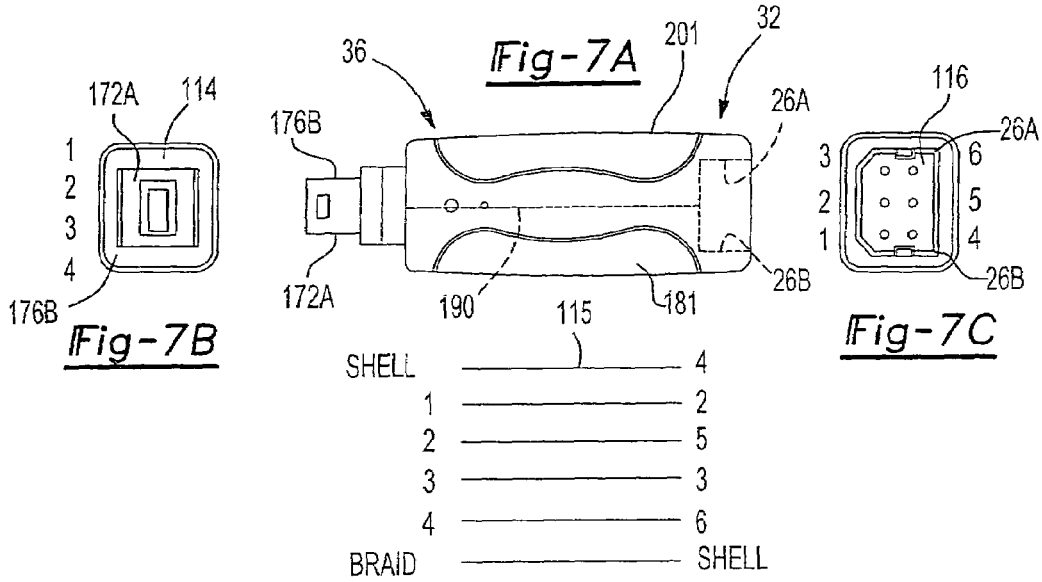
FIG. 7D is a pin-out diagram of the connector of FIG. 7A.
Figure 8D:
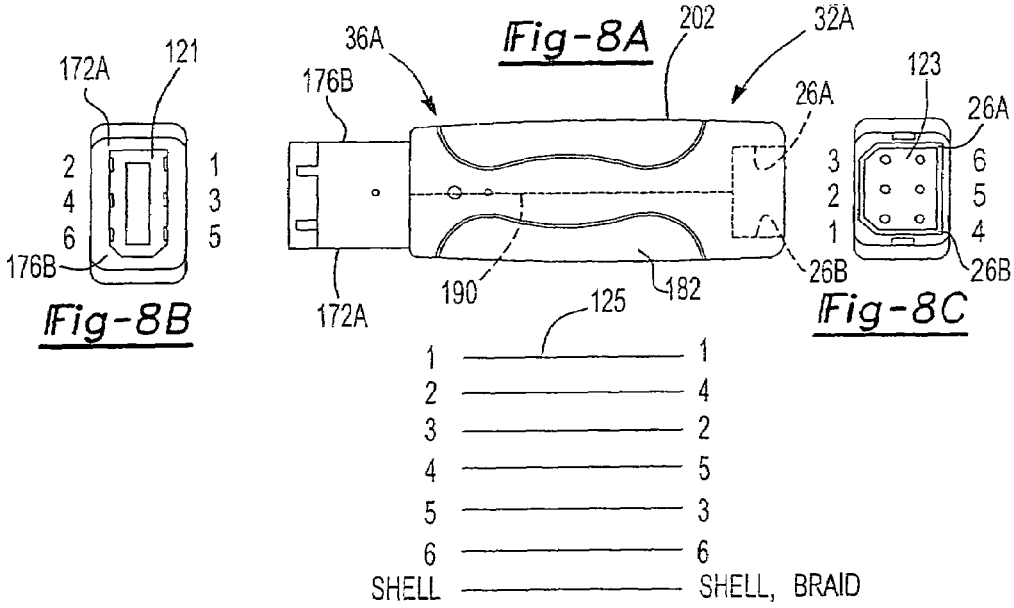
FIG. 8D is a pin-out diagram of the connector of FIG. 8A.
Figure 9D:
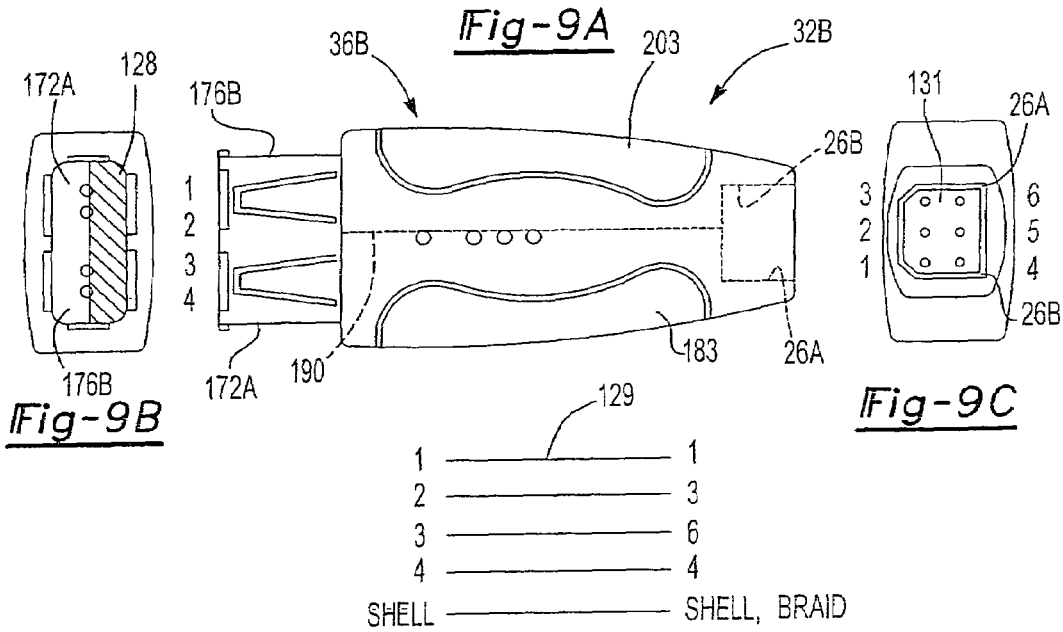
FIG. 9D is a pin-out diagram of the connector of FIG. 9A.
Figure 10D:
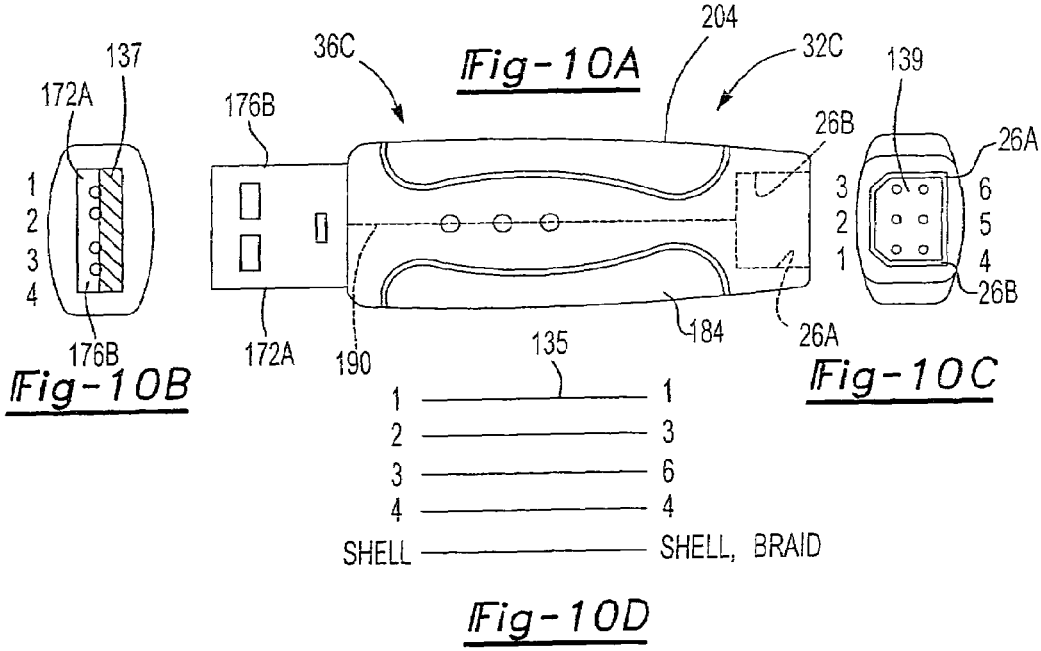
FIG. 10D is a pin-out diagram of the connector of FIG. 10A.

As shown in FIGS. 6A-C, the universal cable first connector portion 24A (as does the universal cable second mating connector portion 24B and the universal first system connector 42) comprises a six pin female connector 160 having a female connector body 161 having a universal connector shelf 178 that electrically and mechanically isolates the two sets of three female pins 163 that are mechanically attached to, or held in fixed relation to the connector body 161 by means well known in the art, such as molding. The female pins 163 have female cable connection points 167, which are the means for making electrical connections to the connector portions 24A, 24B (FIG. 2), and 42 (FIG. 3).

Figure 5A:
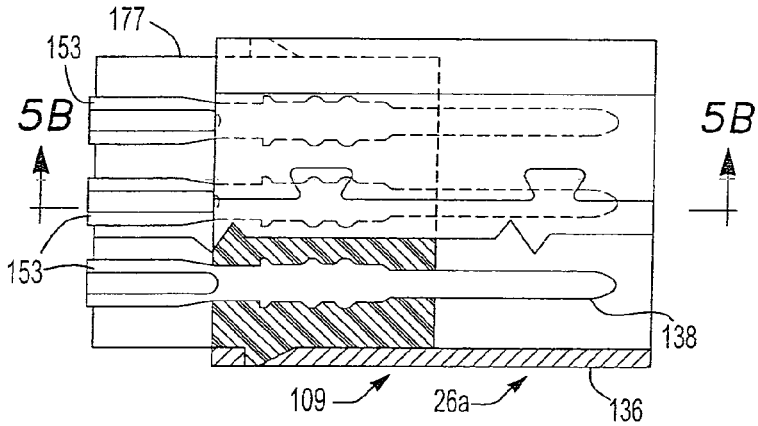
FIG. 5A is a top plan view, partially in section, of the male portion of the connector illustrated in FIG. 4.
Figure 5B:
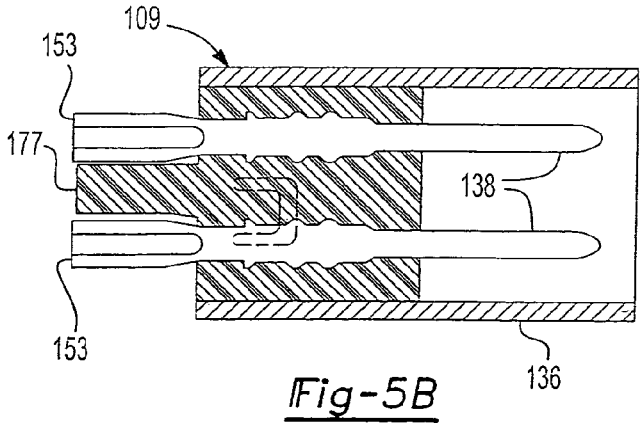
FIG. 5B is a sectional view, taken in the direction of the arrows, along the section line 5B-5B of FIG. 5A.
Figure 5C:
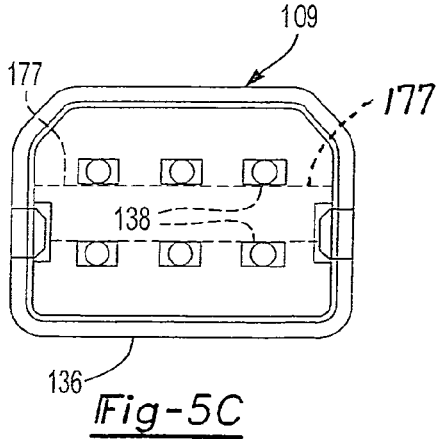
FIG. 5C is a right end view of the connector shown in FIG. 5B.

Illustrated in FIGS. 5A-C, is the universal cable quick connect first mating (male) connector portion 26A (this applies equally to 26B and 44) of the universal cable connector 25 in the form of a six pin male connector 109 of the present invention having six male pins 138 that are mechanically attached to, or held in place in relation to, a male connector body 136 by means well known in the art, and a connector shelf 177 that electrically and mechanically isolate each row of three male pins 138. Male cable connection points 153, which may be part of the male pins 138, aid in electrically attaching the male connector 109 to wires in a cable, for example, the cable portion 22, or a converter, for example, the miniature converter 32. The above-described structure applies equally as well to the universal cable quick connect second mating connector portion 26B and the connector 44.

Referring to FIGS. 7A-D, there is illustrated the first serial bus plug, Firewire® plug, receptacle, or converter 32, or the second serial bus plug, Firewire® plug, receptacle or converter 36 in the form of a Firewire®-IEEE Standard 1394a-2000 201 4-Circuit Plug 201 (said standard being incorporated by reference herein in its entirety), having a first pin arrangement 114 and a second pin arrangement 116, which are mechanically and electrically connected per a first pin-out diagram 115 and in electrical communication therewith.

The 4-Circuit Plug 201, when used as the first serial bus plug, Firewire® plug, receptacle or converter 32 comprises a miniature quick connect first housing 181, a third connector portion 172A, and the universal cable quick connect first mating connector portion 26A, wherein each of the connector portions 172A, 26A is in mechanical attachment with the housing 181 and in electrical attachment with cabling 190, thus allowing electrical communications between the connector portions 172A, 26A.

Similarly, the 4-Circuit Plug 201, when used as the second serial bus plug, Firewire® plug, receptacle or converter 36 comprises the miniature quick connect first housing 181, a fifth connector portion 176B, and the universal cable quick connect second mating connector portion 26B, wherein each of the connector portions 176B, 26B is in mechanical attachment with the housing 181 and in electrical attachment with the cabling 190, thus allowing electrical communications between the connector portions 176B, 26B.

Illustrated in FIGS. 8A-D, there is a first modified first serial bus plug, Firewire® plug, receptacle or converter 32A in the form of a Firewire®-IEEE Standard 1394-1995 (said standard being incorporated by reference herein in its entirety), 6-Circuit Plug 202 having a third pin arrangement 121 and a fourth pin arrangement 123 (substantially identical to the second pin arrangement 116), which are mechanically and electrically connected per a second pin-out diagram 125 and in electrical communication therewith.

The 6-Circuit plug 202, when used as the first modified first serial bus plug, Firewire® plug, receptacle or converter 32A comprises a miniature quick connect second housing 182, the third connector portion 172A, and the universal cable quick connect first mating connector portion 26A, wherein each of the connector portions 172A, 26A is in mechanical attachment with the second housing 182 and in electrical attachment with the cabling 190, thus allowing electrical communications between the connector portions 172A, 26A.

Similarly, the 6-Circuit plug 202, when used as a first modified second serial bus plug, Firewire® plug, receptacle or converter 36A comprises the miniature quick connect second housing 182, the fifth connector portion 176B, and the universal cable quick connect second mating connector portion 26B, wherein each of the connector portions 176B, 26B is in mechanical attachment with the housing 182 and in electrical attachment with the cabling 190, thus allowing electrical communications between the connector portions 176B, 26B.

Illustrated in FIGS. 9A-D is a second modified first serial bus plug, Firewire® plug, receptacle, or converter 32B in the form of a 4 Pin USB Series "A" Receptacle 203, Rev. 2.0 (said standard being incorporated by reference herein in its entirety), having a fifth pin arrangement 128 and a sixth pin arrangement 131 (substantially identical to the second pin arrangement 116), which are mechanically and electrically connected per a third pin-out diagram 129 and in electrical communication therewith.

The 4-pin USB Series "A" receptacle 203, when used as the second modified first serial bus plug, Firewire® plug, receptacle or converter 32B comprises a miniature quick connect third housing 183, the quick connect third mating connector portion 172A, the quick connect first mating connector portion 26A, wherein each of the connector portions 172A, 26A is in mechanical attachment with the housing 183 and in electrical attachment with the cabling 190, thus allowing electrical communications between the connector portions 172A, 26A.

Similarly, the 4-Pin Series "A" receptacle 203, when used as a second modified second serial bus plug, Firewire® plug, receptacle or converter 36B comprises the miniature quick connect third housing 183, the fifth connector portion 176B, and the quick connect second mating connector portion 26B, wherein each of the connector portions 176B, 26B is in mechanical attachment with the housing 183 and in electrical attachment with the cabling 190, thus allowing electrical communications between the connector portions 176B, 26B.

Illustrated in FIGS. 10A-D there is illustrated a third modified first serial bus plug, Firewire® plug, receptacle, or converter 32C in the form of a 4 Pin USB Series "A" Plug 204, Rev. 2.0 (said standard being incorporated by reference herein in its entirety), having a seventh pin arrangement 137 and an eighth pin arrangement 139 (substantially identical to the second pin arrangement 116), which are mechanically and electrically connected per a fourth pin-out diagram 135 and in electrical communication therewith.

The 4-Pin USB Series "A" plug 204, when used as the third modified first serial bus plug, Firewire® plug, receptacle or converter 32C comprises a miniature quick connect fourth housing 184, the third connector portion 172A, and the universal cable quick connect first mating connector portion 26A, wherein each of the connector portions 172A, 26A is in mechanical attachment with the housing 184 and in electrical attachment with the cabling 190, thus allowing electrical communications between the connector portions 172A, 26A.

Similarly, the 4-Pin USB Series "A" plug 204, when used as the third modified second serial bus plug, Firewire® plug, receptacle or converter 36C comprises the miniature quick connect fourth housing 184, the fifth connector portion 176B, and the universal cable quick connect second mating connector portion 26B, wherein each of the connector portions 176B, 26B are in mechanical attachment with the housing 184 and in electrical attachment with the cabling 190, thus allowing electrical communications between the connector portions 176B, 26B.

Illustrated in FIGS. 11A-D, is a fourth modified first serial bus plug, Firewire® plug, receptacle, or converter 32D in the form of a 4 Pin USB Series "B" Plug 205, Rev. 2.0 (said standard being incorporated by reference herein in its entirety), having a ninth pin arrangement 143 and a tenth pin arrangement 146 (substantially identical to the second pin arrangement 116), which are mechanically and electrically connected per a fifth pin-out diagram 147 and in electrical communication therewith.

The 4-Pin USB-Series "B" plug 205, when used as the fourth modified first serial bus plug, Firewire® plug, receptacle or converter 32D comprises a miniature quick connect fifth housing 185, the third connector portion 172A, and the universal cable quick connect first mating connector portion 26A, wherein each of the connector portions 172A, 26A is in mechanical attachment with the housing 185 and in electrical attachment with the cabling 190, thus allowing electrical communications between the connector portions 172A, 26A.

Similarly, the 4-Pin USB Series "B" plug 205, when used as the fourth modified second serial bus plug, Firewire® plug, receptacle or converter 36D comprises the miniature quick connect fifth housing 185, the fifth connector portion 176B, and the universal cable quick connect second mating connector-portion 26B, wherein each of the connector portions 176B, 26B is in mechanical attachment with the housing 185 and in electrical attachment with the cabling 190, thus allowing electrical communications between the connector portions 176B, 26B.

Illustrated in FIGS. 12A-D, is a fifth modified first serial bus plug, Firewire® plug, receptacle, or converter 32E in the form of a 5 Pin USB 2.0 Specification Mini-"A" Plug 206, Rev. 1.0 (said standard being incorporated by reference herein in its entirety), having an eleventh pin arrangement 152 and a twelfth pin arrangement 154 (substantially identical to the second pin arrangement 116), which are mechanically and electrically connected per a sixth pin-out diagram 151 and in electrical communication therewith.

The 5-Pin USB Mini-"A" plug 206 when used as the fifth modified first serial bus plug, Firewire® plug, receptacle or converter 32E comprises a miniature quick connect sixth housing 186, the third connector portion 172A, and the universal cable quick connect first mating connector portion 26A, wherein each of the connector portions 172A, 26A is in mechanical attachment with the housing 186 and in electrical attachment with the cabling 190, thus allowing electrical communications between the connector portions 172A, 26A.

Similarly, the 5-Pin USB Mini "A" plug 206, when used as the fifth modified second serial bus plug, Firewire® plug, receptacle or converter 36E comprises the miniature quick connect sixth housing 186, the fifth connector portion 176B, and the universal cable quick connect second mating connector portion 26B, wherein each of the connector portions 176B, 26B are in mechanical attachment with the housing 186 and in electrical attachment with the cabling 190, thus allowing electrical communications between the connector portions 176B, 26B.

Illustrated in FIGS. 13A-D, of the present invention, is a sixth modified first serial bus plug, Firewire® plug, receptacle, or converter 32F in the form of a 4 Pin USB 2.0 Specification Mini-"B" Plug 207, Rev. 1.0 (said standard being incorporated by reference herein in its entirety), having a thirteenth pin arrangement 158 and a fourteenth pin arrangement 162 (substantially identical to second pin arrangement 116), which are mechanically and electrically connected per a seventh pin-out diagram 155 and in electrical communication therewith.

The 4-Pin USB-"Mini-B" plug 207, when used as the sixth modified first serial bus plug, Firewire® plug, receptacle or converter 32F, comprises a miniature quick connect seventh housing 187, the third connector portion 172A, and the universal cable quick connect first mating connector portion 26A, wherein each of the connector portions 172A, 26A is in mechanical attachment with the housing 187 and in electrical attachment with the cabling 190, thus allowing electrical communications between the connector portions 172A, 26A.

Similarly, the 4-Pin USB "Mini-B" plug 207, when used as the sixth modified second serial bus plug, Firewire® plug, receptacle or converter 32F, comprises the miniature quick connect seventh housing 187, the fifth connector portion 176B, and the universal cable quick connect second mating connector-portion 26B, wherein each of the connector portions 176B, 26B are in mechanical attachment with the housing 187 and in electrical attachment with the cabling 190, thus allowing electrical communications between the connector portions 176B, 26B.

Figure 14:
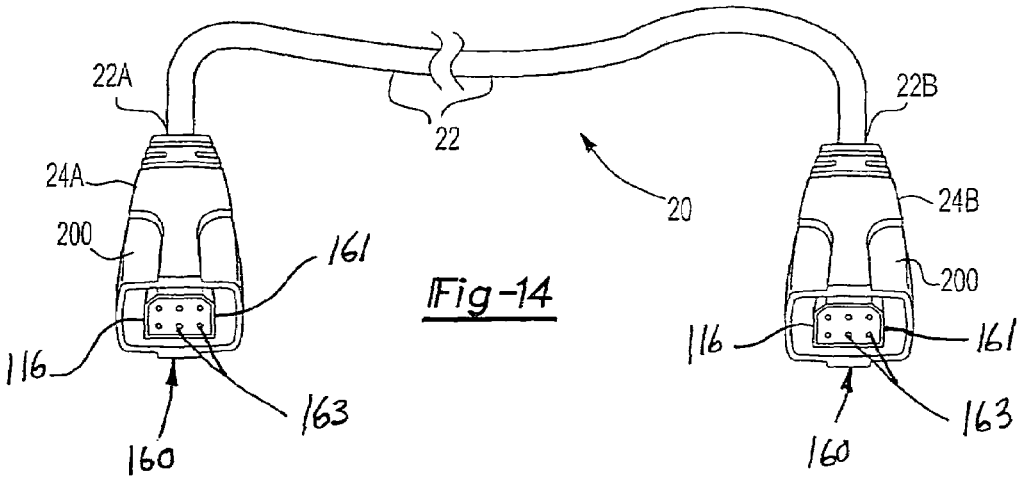
FIG. 14 is a perspective view of the cable shown in FIGS. 1-2.

Referring to FIG. 14, since the second pin arrangement 116, the fourth pin arrangement 123, the sixth pin arrangement 131, the eighth pin arrangement 139, the tenth pin arrangement 146, the twelfth pin arrangement 154, the fourteenth pin arrangement 162 and an $n^{th}$ pin arrangement (not shown) are all substantially identical, the single universal cable 20 having the first universal cable connector portion 24A, and the second universal cable connector portion 24B can accept all necessary plugs, receptacles or converters (32, 36) which are needed to connect computers, computer peripherals, computer related devices and other devices together.

The first connector portion 24A and the second connector portion 24B each has a connector housing 200, which preferably are identical. Mechanically attached to each connector housing 200 is the six pin-female connector 160, such as that illustrated in FIGS. 4 and 6. Since each six pin female connector 160 has the female connector body 161, the connector shelf 178, and the female connection points 167, the six pin female connector 160 is easily connected to the cable portion 22 of the universal cable 20 by means well known in the art. Each six pin female connector 160 will be mechanically attached to the connector housing 200, and electrically connected to the cable portion 22.

A method of connecting computers to computer peripherals is provided utilizing a universal cable and a quick connect connector comprising the steps of: a) providing the universal computer cable (USB or Firewire®) 20 having a universal cable connector portion (female) (24A, 24B) electrically connected to an end of the universal computer cable, b) providing a universal cable miniature quick connect connector having a universal cable quick connect mating connector portion (26A, 26B), and c) connecting the universal cable connector to the quick connect connector by plugging the universal cable connector portion into the quick connect mating connector portion.

Also provided is a method of connecting external electrical equipment to computers and computer peripherals that comprises: a) providing the universal cable 20 having the universal cable first end 22A and the second end 22B, wherein the universal cable first end has a universal cable first or female connector portion electrically connected thereto, which is in electrical communication with the universal cable second end 22B that is electrically connected to external electrical equipment, b) providing at least one quick connect serial bus plug or receptacle or converter 32 having a quick connect mating or male connector portion, and c) connecting the external electrical equipment to the at least one quick connect serial bus plug or receptacle or converter 32 by plugging the universal cable first connector portion 24A into the quick connect mating connector 26A.

Because the universal cable connector portions, and the quick connect mating connector portions may remain unchanged and accommodate a large number of first and/or second serial bus plugs, Firewire® plugs, receptacles and/or converters, a truly universal cable system is provided.

Figure 15:
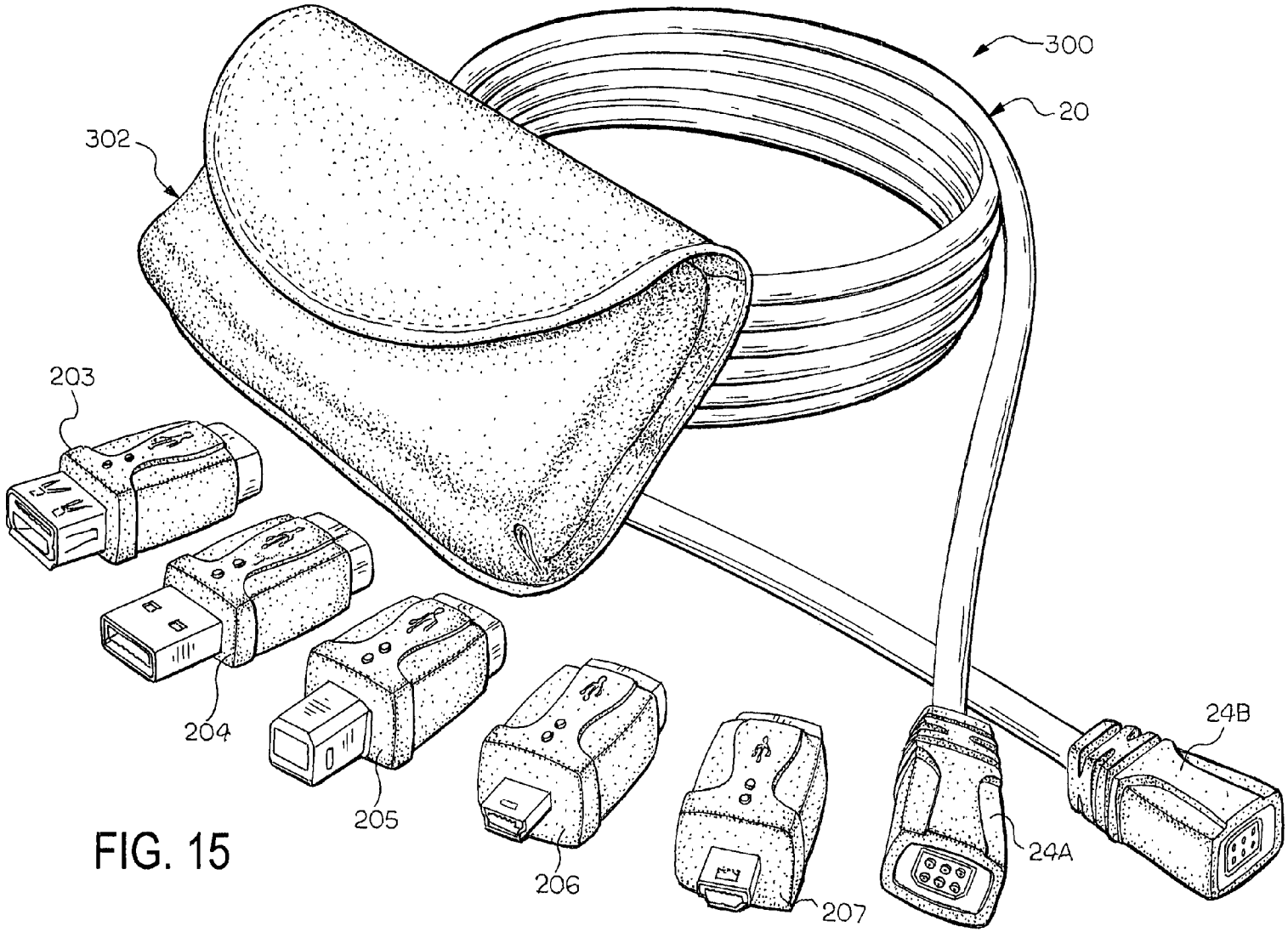
FIG. 15 is a perspective view of a universal computer cable kit in accordance with the present invention.

Referring now to FIG. 15, a universal computer cable kit in accordance with the present invention is indicated generally at 300. The kit 300 includes the universal cable 20 having the universal cable first connector portion 24A and the universal cable second connector portion 24B attached to opposing ends thereof, the 4-Pin USB Series "A" Receptacle 203, the 4 Pin USB Series "A" Plug 204, the 4-Pin USB Series "B" Plug 205, the 5-Pin USB 2.0 Specification Mini-"A" Plug 206, and the 4-Pin USB 2.0 Specification Mini-"B" Plug 207, collectively referred to as interchangeable connectors. The kit 300 also includes a container 302 that is sized to contain all of the connectors 203 through 207. The interchangeable connectors 203 through 207 are each operable to be interchangeably and releasably connected to either the universal cable first connector portion 24A and the universal cable second connector portion 24B.

The interchangeability of the connectors 203 through 207 of the kit 300 advantageously allows the universal cable 20 to be configured in a plurality of configurations, depending on the needs of the user of the universal cable 20. In a first configuration of the kit 300, the 4-Pin USB Series "A" plug 204 is attached to a one of the universal cable first connector portion 24A and the universal cable second connector portion 24B and the 4-Pin USB Series "B" plug 205 is attached to the other of the universal cable first connector portions, as outlined in more detail above. In the first configuration of the kit 300, the universal cable 20 is advantageously operable to connect a computer or hub (not shown) to a printer (not shown), a scanner (not shown), or a CD/DVD drive (not shown), such as by connecting the Pin USB Series "A" plug 204 to the computer or hub and connecting the 4-Pin USB Series "B" plug 205 to the printer, the scanner or the CD/DVD drive.

In a second configuration of the kit 300, the 4-Pin Series "A" receptacle 203 is attached to a one of the universal cable first connector portion 24A and the universal cable second connector portion 24B and the 4-Pin USB Series "A" plug 204 is attached to the other of the universal cable first connectors, as outlined in more detail above. In the second configuration of the kit 300, the universal cable 20 is advantageously operable to provide a USB extension cable.

In a third configuration of the kit 300, the 4-Pin USB Series "A" plug 204 is attached to a one of the universal cable first connector portion 24A and the universal cable second connector portion 24B and the 4-Pin USB-"Mini-B" plug 207 is attached to the other of the universal cable first connectors, as outlined in more detail above. In the third configuration of the kit 300, the universal cable 20 is advantageously operable to connect the computer or hub to a PDA (not shown), a digital camera (not shown), or a MP3 player (not shown), such as by connecting the 4-Pin USB Series "A" plug 204 to the computer or hub and connecting the 4-Pin USB-"Mini-B" plug 207 to the PDA, the digital camera or the MP3 player.

In a fourth configuration of the kit 300, the 5-Pin USB Mini "A" plug 206 is attached to a one of the universal cable first connector portion 24A and the universal cable second connector portion 24B and the 4-Pin USB-"Mini-B" plug 207 is attached to the other of the universal cable first connectors, as outlined in more detail above. In the fourth configuration of the kit 300, the universal cable 20 is advantageously operable to connect the PDA to a cell phone (not shown), to connect the cell phone to the digital camera and to connect the MP3 player to another MP3 player, such as by connecting the 5-Pin USB Mini "A" plug 206 to the PDA, the cell phone, or the MP3 player and connecting the 4-Pin USB-"Mini-B" plug 207 to the cell phone, the digital camera, or the other MP3 player.

In a fifth configuration of the kit 300, the 5-Pin USB Mini "A" plug 206 is attached to a one of the universal cable first connector portion 24A and the universal cable second connector portion 24B and the 4-Pin USB Series "B" plug 205 is attached to the other of the universal cable first connector portions, as outlined in more detail above. In the fifth configuration, the universal cable 20 is advantageously operable to connect the PDA to the printer or to a hard drive (not shown), or to connect the digital camera to the printer, such as by connecting the 5-Pin USB Mini "A" plug 206 to the PDA or the digital camera and connecting the 4-Pin USB Series "B" plug 205 to the printer or the hard drive.

When the kit 300 is configured in any of the configurations detailed above, the container 302 securely stores those of the 4-Pin USB Series "A" Receptacle 203, the 4 Pin USB Series "A" Plug 204, the 4-Pin USB Series "B" Plug 205, the 5-Pin USB 2.0 Specification Mini-"A" Plug 206, and the 4-Pin USB 2.0 Specification Mini-"B" Plug 207 that are not used in the current configuration.

Figure 16:
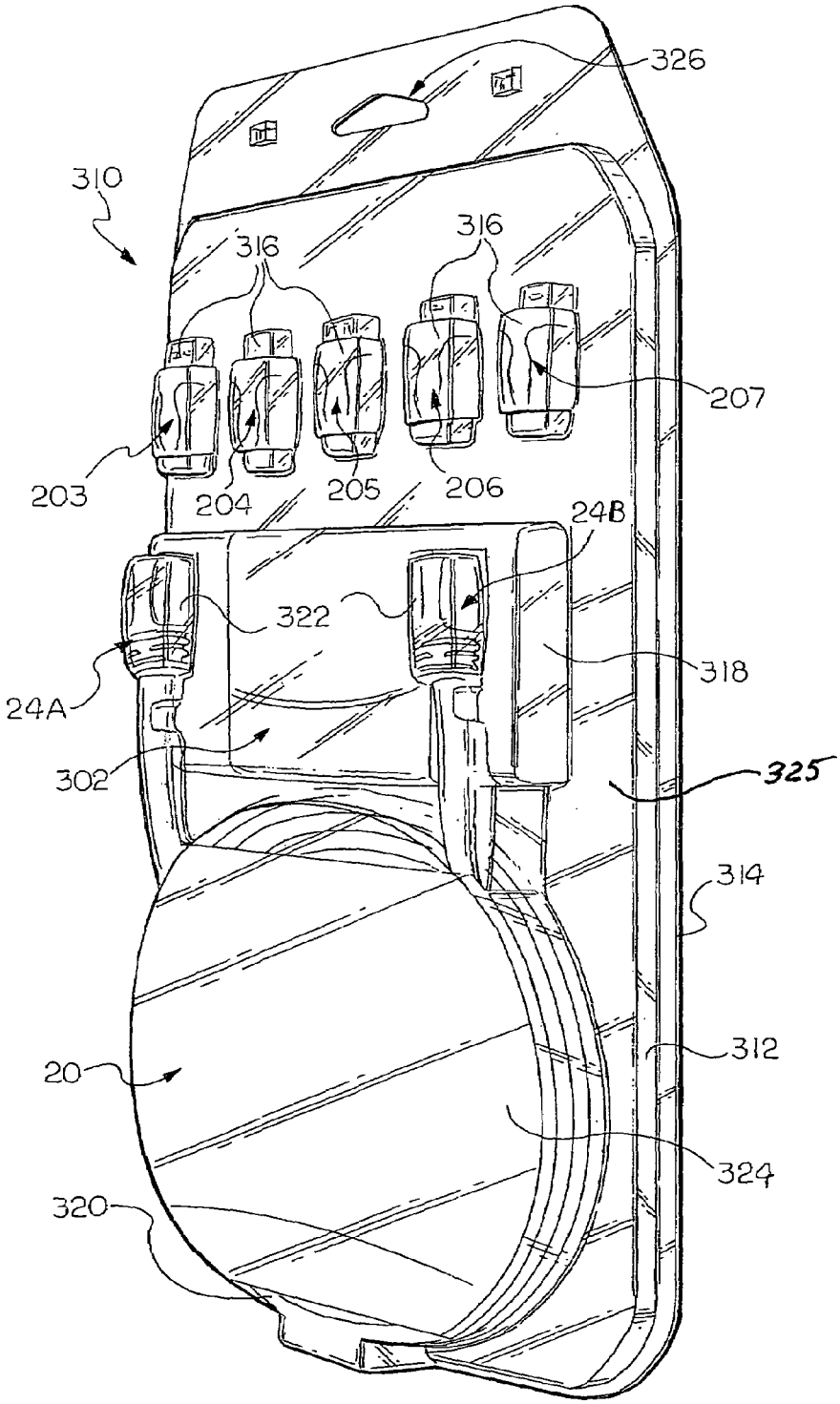
FIG. 16 is a perspective view of the universal computer cable kit of FIG. 15 shown in a blister pack.

Referring now to FIG. 16, the kit 300 is shown encased in a blister pack 310 used for packaging and displaying the kit 300. The blister pack 310 includes a first side wall 312 and a second side wall 314 attached together for enclosing the kit 300 therein and forming a display. The first side 312 is formed of a transparent material and includes a plurality of smaller, generally rectangular protuberances 316 extending therefrom near an upper end, each of which defines a corresponding recess for one of the interchangeable connectors 203 through 207. An intermediate size, generally rectangular protuberance 318 is formed in the first side 312 to define a recess for the container 302. A larger, generally circular protuberance 320 is formed at a lower end of the first side 312 to define a recess for the coiled universal cable 20. A pair of smaller, generally rectangular protuberances 322 are formed on the protuberance 320 to define a corresponding recesses for the universal cable first connector portion 24A and the universal cable second connector portion 24B. The blister pack 310 may also enclose a first insert 324, formed of a cardboard or the like material, shaped to fit into the protuberance 320 in front of the cable 20 for displaying information and/or images. A second insert 325, formed of a cardboard or the like material, is shaped to fit between the first wall 312 and the second wall 314 for displaying information and/or images. The second wall 314 can be formed of a transparent material. An aperture 326 is formed in an upper portion of the blister pack 310 and extend through the walls 312, 314 for use in hanging the blister pack 300 for display.

Figure 17:
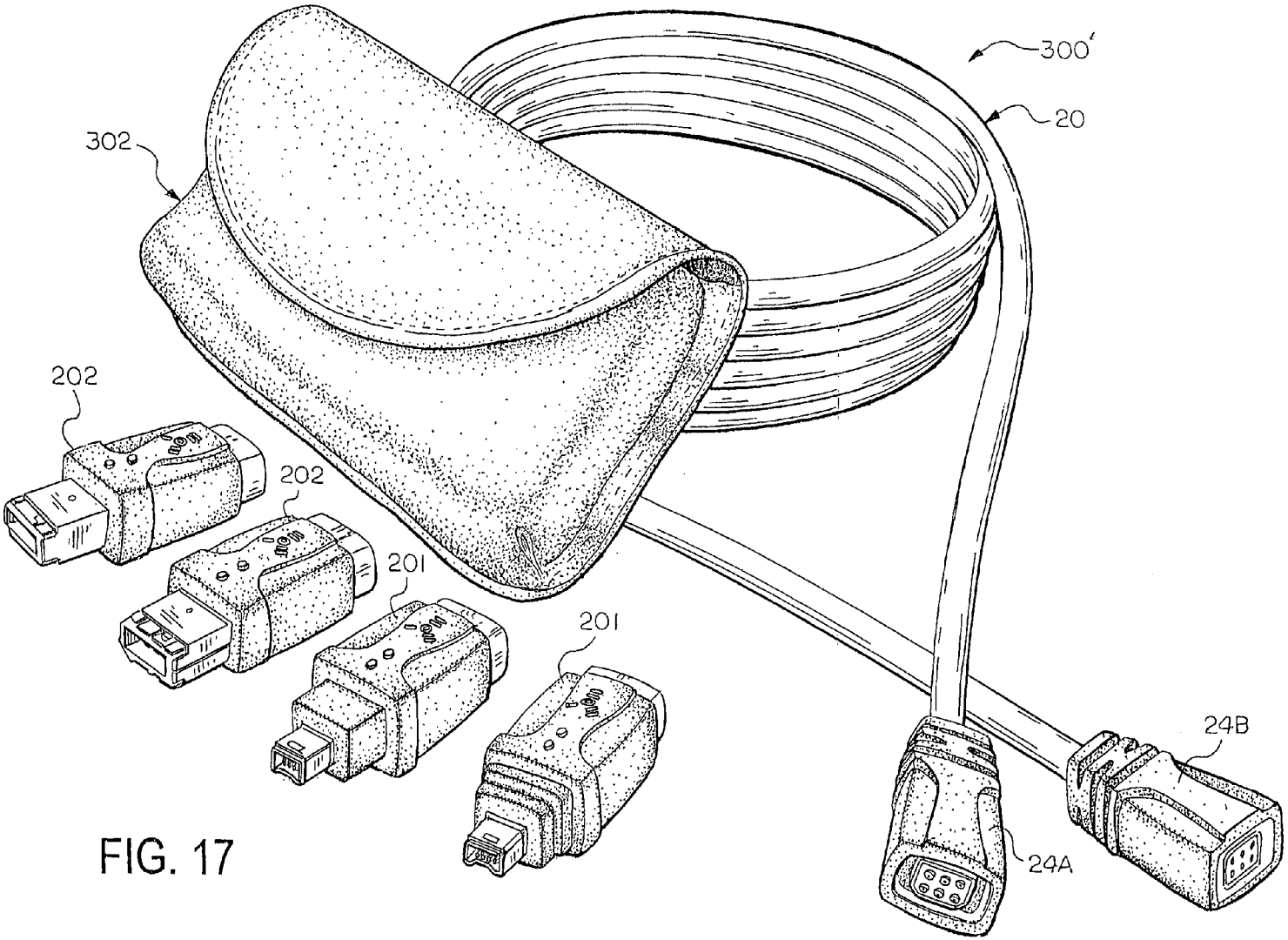
FIG. 17 is a perspective view of an alternative embodiment of a universal computer cable kit in accordance with the present invention.

Referring now to FIG. 17, an alternative embodiment of a kit in accordance with the present invention is indicated generally at 300'. The kit 300' includes the universal cable 20 having the universal cable first connector portion 24A and the universal cable second connector portion 24B, a pair of the Firewire®-IEEE Standard 1394a-2000 201 4-Circuit Plugs 201 and a pair of the Firewire®-IEEE Standard 1394-1995 6-Circuit Plugs 202, the plugs collectively referred to as interchangeable connectors. The kit 300' also includes the container 302 that is sized to store all of the plugs 201, 202. The interchangeable connectors 201, 202 are each operable to be interchangeably and releasably connected to the universal cable first connector portion 24A and the universal cable second connector portion 24B.

The interchangeability of the connectors 201, 202 of the kit 300' advantageously allows the universal cable 20 to be configured in a plurality of configurations, depending on the needs of the user of the universal cable 20. In a first configuration of the kit 300', a one of the 4-Circuit Plugs 201 is attached to a one of the universal cable first connector portion 24A and the universal cable second connector portion 24B and a one of the 6-Circuit Plugs 202 is attached to the other universal cable first connector portion, as outlined in more detail above. In the first configuration of the kit 300', the universal cable 20 is advantageously able to connect the computer or the hub to a digital video camera (not shown) or to audio mixing equipment (not shown), such as by connecting the 4-Circuit Plug 201 to the computer or the hub and connecting the 6-Circuit Plug 202 to the digital video camera or to the audio mixing equipment.

In a second configuration of the kit 300', a one of the 4-Circuit Plugs 201 is attached to a one of the universal cable first connector portion 24A and the universal cable second connector portion 24B and the other 4-Circuit Plug 201 is attached to the other of the universal cable first connector portions, as outlined in more detail above. In the second configuration of the kit 300', the universal cable 20 is advantageously able to connect the digital video camera to another digital video camera or the audio mixing equipment, and to connect the audio mixing equipment to the digital video camera or to another audio mixing equipment, such as by connecting one of the 4-Circuit plugs 201 to the digital video camera or the audio mixing equipment and connecting the other 4-Circuit plug 201 to the other digital video camera or the other audio mixing equipment.

In a third configuration of the kit 300', a one of the 6-Circuit Plugs 202 is attached to a one of the universal cable first connector portion 24A and the universal cable second connector portion 24B and the other 6-Circuit Plug 202 is attached to the other of the universal cable first connector portions, as outlined in more detail above. In the third configuration of the kit 300', the universal cable 20 is advantageously able to connect the computer or hub to another computer or hub, to the scanner, to the CD/DVD drive or to the hard drive, such as by connecting one of the 6-Circuit Plugs 202 to the computer or hub and connecting the other 6-Circuit Plug 202 to the other computer or hub, to the scanner, to the CD/DVD drive or to the hard drive.

When the kit 300' is configured in any of the configurations detailed above, the container 302 securely store those of the 4-Circuit Plugs 201 and the 6-Circuit Plugs 202 that are not used in the current configuration.

Those skilled in the art will appreciate that various combinations of the interchangeable ends 201 through 207 may be provided and that more or fewer of the interchangeable ends 201 through 207 including, but not limited to, Firewire® plugs, receptacles, and/or converters may be provided with the universal cable 20 and/or the container 302 to form a kit, such as the kit 300 or 300', while remaining within the scope of the present invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A universal computer cable kit, comprising:

an electrical cable portion having a first end, a second end, and six conductors for electrically transmitting signals, said second end being electrically connected to said first end by said six conductors;

a pair of electrical cable connector portions, each said connector portion being electrically and mechanically connected to an associated one of said cable portion ends to form an electrical cable, and each said connector portion including a connector body with only six pins disposed within said connector body, each said pin being electrically connected to an associated one of said six conductors;

at least three interchangeable quick connectors having a first end and an opposite second end wherein said first end of each is adapted to be releasably attached to said connector portions of said first and second ends and said second end being adapted to electrically connect conventional connectors of a pair of electrical devices, wherein said second ends of two of the at least three interchangeable quick connectors are adapted to connect to different types of conventional connectors having different electrical wiring schemes and said at least three interchangeable quick connectors convert said wiring scheme of the conventional connector to electrically interface with said pins of said connector portions; and a container for storing said quick connectors when not in use on said electrical cable.

2. The kit according to claim 1 wherein said second end of at least one of said quick connectors includes one of a 4-Pin USB Series "A" Receptacle, a 4 Pin USB Series "A" Plug, a 4-Pin USB Series "B" Plug, a 5-Pin USB 2.0 Specification Mini-"A" Plug, a 4-Pin USB 2.0 Specification Mini-"B" Plug, a Firewire®-IEEE Standard 1394a-2000 4-Circuit plug and a Firewire®-IEEE Standard 1394-1995 6-Circuit Plug.

3. The kit according to claim 1 wherein said second end of said quick connectors include one of a 4-Pin USB Series "A" Receptacle, a 4 Pin USB Series "A" Plug, a 4-Pin USB Series "B" Plug, a 5-Pin USB 2.0 Specification Mini-"A" Plug, and a 4-Pin USB 2.0 Specification Mini-"B" Plug.

4. The kit according to claim 1 wherein said second end of said quick connectors include two of a Firewire®-IEEE Standard 1394a-2000 4-Circuit plug and two of a Firewire®-IEEE Standard 1394-1995 6-Circuit Plug.

5. The kit according to claim 1 wherein said second end of at least one of said quick connectors includes no more than four pins for connection with corresponding ones of said six pins in said connector body via said quick connector.

6. The kit according to claim 5 wherein said first end of said quick connectors includes six pins for connection with corresponding ones of said six pins in said connector body and said second end includes a pin configuration different from said first end and wherein said quick connectors enable electrical connection between said different pin configurations.

7. The kit according to claim 6 wherein only four of said six conductors of said electrical cable portion are electrically transmitting signals to and from the one of said at least four quick connectors attached thereto.

8. The kit according to claim 1 including a blister pack enclosing said universal cable, said quick connectors and said container.

9. The kit according to claim 8 wherein said blister pack has a transparent wall having a plurality of protuberances formed therein receiving said universal cable, said quick connectors and said container.

10. The kit according to claim 9 wherein one of said protuberances is generally circular for receiving said universal cable portion.

11. The kit according to claim 9 wherein one of said protuberances is generally rectangular for receiving said container.

12. The kit according to claim 9 wherein said protuberances include generally rectangular protuberances for separately receiving each of said connector portions and said quick connectors.

13. A universal computer cable kit, comprising:

an electrical cable portion having a first end and a second end electrically connected to said first end;

a pair of cable connector portions, each said connector portion being electrically and mechanically connected to an associated one of said cable portion ends to form a cable for connecting USB devices; and at least three interchangeable quick connectors each adapted to be releasably attached to said connector portions of said first and second ends to electrically connect conventional USB connectors of a pair of the USB devices through said cable portion.

14. The kit according to claim 13 including a blister pack enclosing said universal cable and said quick connectors.

15. The kit according to claim 13 wherein said quick connectors include one of a 4-Pin USB Series "A" Receptacle, a 4 Pin USB Series "A" Plug, a 4-Pin USB Series "B" Plug, a 5-Pin USB 2.0 Specification Mini-"A" Plug, and a 4-Pin USB 2.0 Specification Mini-"B" Plug.

16. A universal computer cable kit, comprising:

an electrical cable portion having a first end and a second end electrically connected to said first end;

a pair of electrical cable connector portions, each said connector portion being electrically and mechanically connected to an associated one of said cable portion ends to form a universal cable;

at least four interchangeable quick connectors having a first end and an opposite second end wherein said first end of each is adapted to be releasably attached to said connector portions of said first and second ends and said second end being adapted to electrically connect conventional connectors of a pair of electrical devices wherein said pair of electrical devices each utilize a different conventional connector;

a container for storing said quick connectors when not in use on said electrical cable; and a blister pack enclosing said electrical cable, said quick connectors and said container and wherein said blister pack has a transparent wall having a plurality of protuberances formed therein receiving said electrical cable, said quick connectors and said container.

17. The kit according to claim 16 wherein one of said protuberances is generally circular for receiving said universal cable portion.

18. The kit according to claim 16 wherein one of said protuberances is generally rectangular for receiving said container.

19. The kit according to claim 16 wherein said protuberances include generally rectangular protuberances for separately receiving each of said connector portions and said quick connectors.

* * * * *